US011448076B2

(12) United States Patent
Webster et al.

(10) Patent No.: US 11,448,076 B2
(45) Date of Patent: Sep. 20, 2022

(54) ENGINE COMPONENT WITH COOLING HOLE

(71) Applicant: GENERAL ELECTRIC COMPANY, Schenectady, NY (US)

(72) Inventors: Zachary Daniel Webster, Mason, OH (US); Gregory Terrence Garay, West Chester, OH (US); Steven Robert Brassfield, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/213,771

(22) Filed: Mar. 26, 2021

(65) Prior Publication Data

US 2021/0239005 A1 Aug. 5, 2021

Related U.S. Application Data

(63) Continuation of application No. 15/898,703, filed on Feb. 19, 2018, now Pat. No. 10,975,704.

(51) Int. Cl.
*F01D 5/18* (2006.01)

(52) U.S. Cl.
CPC ..... *F01D 5/187* (2013.01); *F05D 2220/323* (2013.01); *F05D 2260/201* (2013.01)

(58) Field of Classification Search
CPC . F01D 5/14; F01D 5/141; F01D 5/147; F01D 5/18; F01D 5/186; F01D 5/187; F05D 2220/323; F05D 2260/20; F05D 2260/201; F05D 2260/202; F05D 2260/203; F05D 2260/204
See application file for complete search history.

(56) References Cited

U.S. PATENT DOCUMENTS

| | | | |
|---|---|---|---|
| 3,819,295 | A | 6/1974 | Hauser et al. |
| 5,125,798 | A | 6/1992 | Muth et al. |
| 5,407,150 | A | 4/1995 | Sadleir |
| 5,511,946 | A | 4/1996 | Lee et al. |
| 6,257,831 | B1 | 7/2001 | Papple et al. |
| 6,280,140 | B1 | 8/2001 | Soechting et al. |
| 7,118,337 | B2 | 10/2006 | Liang |
| 7,300,250 | B2 | 11/2007 | Papple |
| 7,572,103 | B2 | 8/2009 | Walters et al. |
| 8,011,889 | B1 | 9/2011 | Liang |
| 9,482,101 | B2 | 11/2016 | Xu |
| 9,810,072 | B2 | 11/2017 | Dong et al. |
| 2004/0151586 | A1 | 8/2004 | Chlus et al. |
| 2005/0025167 | A1 | 2/2005 | Ishibashi et al. |

(Continued)

FOREIGN PATENT DOCUMENTS

EP 2942485 A1 11/2015

*Primary Examiner* — Courtney D Heinle
*Assistant Examiner* — Sang K Kim
(74) *Attorney, Agent, or Firm* — McGarry Bair PC

(57) ABSTRACT

An apparatus and method an engine component for a turbine engine comprising an outer wall bounding an interior and defining a pressure side and an opposing suction side, with both sides extending between a leading edge and a trailing edge to define a chord-wise direction, and extending between a root and a tip to define a span-wise direction, at least one cooling passage located within the interior, at least one cooling hole having an inlet fluidly coupled to the cooling passage and an outlet located along the outer wall.

20 Claims, 10 Drawing Sheets

(56) References Cited

U.S. PATENT DOCUMENTS

| | | | | |
|---|---|---|---|---|
| 2007/0007160 | A1 | 1/2007 | Tattam | |
| 2010/0008759 | A1* | 1/2010 | Johns | F01D 5/186 415/115 |
| 2010/0129231 | A1 | 5/2010 | Brittingham et al. | |
| 2016/0003056 | A1 | 1/2016 | Xu | |
| 2016/0069189 | A1 | 3/2016 | Quach et al. | |
| 2016/0169002 | A1 | 6/2016 | Chlus et al. | |
| 2017/0030198 | A1 | 2/2017 | Kruckels et al. | |
| 2017/0114646 | A1* | 4/2017 | Sreekanth | F23R 3/005 |
| 2017/0298823 | A1* | 10/2017 | Harding | F02C 7/12 |
| 2017/0370229 | A1 | 12/2017 | Garay et al. | |
| 2019/0186272 | A1 | 6/2019 | Webster et al. | |
| 2019/0210132 | A1 | 7/2019 | Dyson et al. | |

* cited by examiner

ENGINE COMPONENT WITH COOLING HOLE

CROSS REFERENCE TO RELATED APPLICATION

This application is a continuation of U.S. patent application Ser. No. 15/898,703 filed Feb. 19, 2018, now U.S. Pat. No. 10,975,704, issued Apr. 13, 2021, which is incorporated herein in its entirety.

BACKGROUND OF THE INVENTION

Turbine engines, and particularly gas or combustion turbine engines, are rotary engines that extract energy from a flow of combusted gases passing through the engine onto a multitude of rotating turbine blades.

Turbine blade assemblies include the turbine airfoil, such as a stationary vane or rotating blade, with the blade having a platform and a dovetail mounting portion. The turbine blade assembly includes cooling inlet passages as part of serpentine circuits in the platform and blade used to cool the platform and blade. The serpentine circuits can extend to cooling holes located along any of the multiple surfaces of the blade including at the tip, trailing edge, and leading edge. Nozzles comprising a pair of stationary vanes located between inner and outer bands and combustor liners surrounding the combustor of the engine can also utilize cooling holes and/or serpentine circuits.

BRIEF DESCRIPTION OF THE INVENTION

In one aspect, the present disclosure relates to a component for a turbine engine, which generates a hot gas flow, and provides a cooling fluid flow, comprising a wall separating the hot gas flow from the cooling fluid flow and having a heated surface along which the hot gas flows and a cooled surface facing the cooling fluid flow; and at least one cooling hole comprising at least one inlet at the cooled surface and at least one outlet at the heated surface, at least one connecting passage extending between the at least one inlet and the at least one outlet, with an impingement cavity formed in the at least one connecting passage, the at least one connecting passage including a first portion upstream of the impingement cavity and a second portion downstream of the impingement cavity having an inverse diffusing section with a converging section having a cross-sectional area that decreases toward the at least one outlet.

In another aspect, the present disclosure relates to a component for a turbine engine, which generates a hot gas flow, and provides a cooling fluid flow, comprising a wall separating the hot gas flow from the cooling fluid flow and having a heated surface along which the hot gas flows and a cooled surface facing the cooling fluid flow; and at least one cooling hole comprising at least one inlet at the cooled surface and at least one outlet at the heated surface, at least one connecting passage extending between the at least one inlet and the at least one outlet, the at least one connecting passage comprising a first portion extending in a first direction having a first cross-sectional area defining a first centerline, a second portion extending in a second direction different than the first direction and having a second cross-sectional area defining a second centerline, a turn located between the first portion and the second portion and defining an impingement cavity, a diffusing section located in the first portion with the first cross-sectional area increasing in the first direction toward the turn.

DETAILED DESCRIPTION OF THE INVENTION

Figure 1:
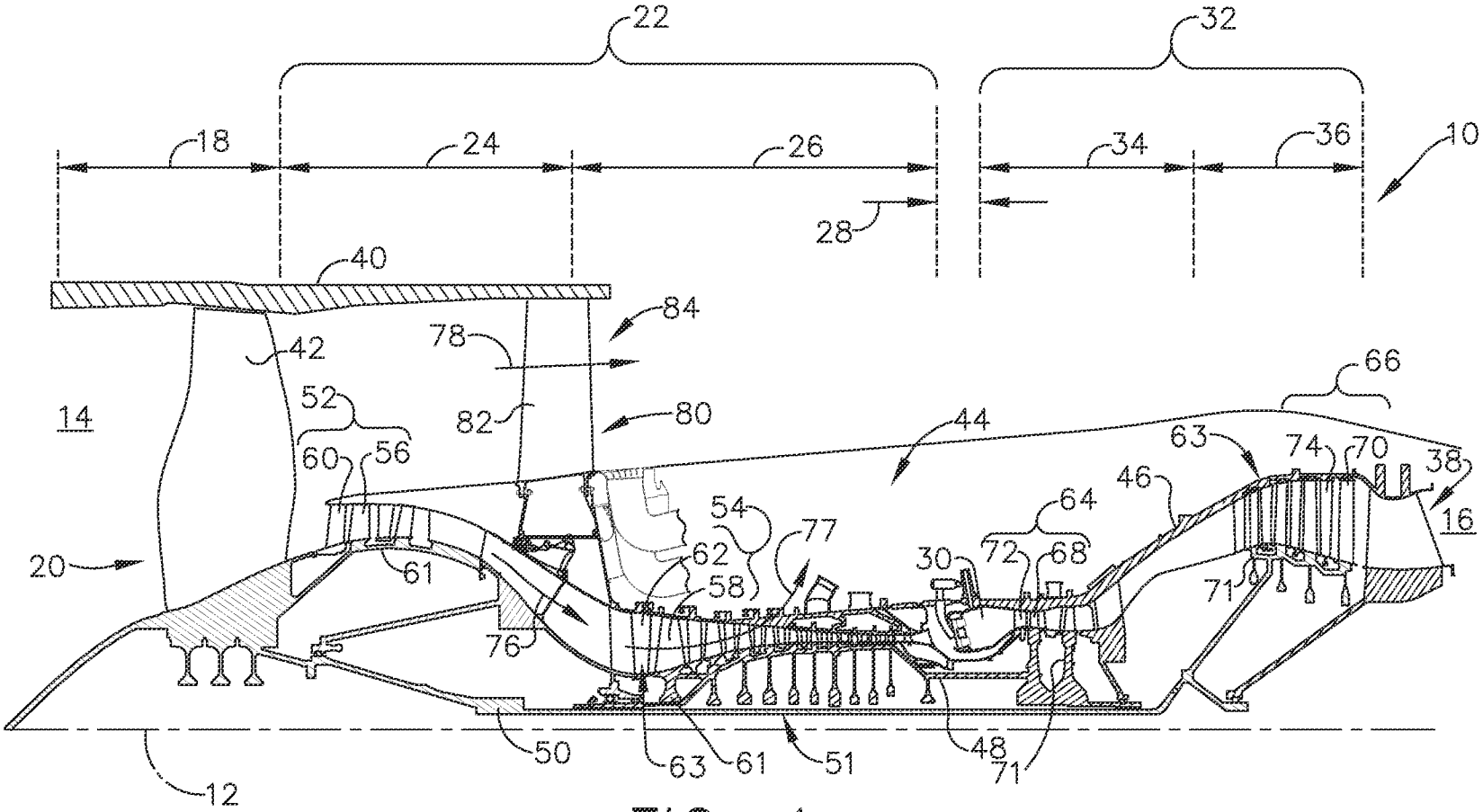
FIG. 1 is a schematic cross-sectional diagram of a turbine engine for an aircraft.

Aspects of the disclosure described herein are directed to the formation of at least one cooling hole having an inlet fluidly coupled to a cooling passage and an outlet located along an outer wall of the engine component and an impingement cavity located within. For purposes of illustration, the present disclosure will be described with respect to a turbine blade in the turbine for an aircraft gas turbine engine. It will be understood, however, that aspects of the disclosure described herein are not so limited and may have general applicability within an engine, including compressors, as well as in non-aircraft applications, such as other mobile applications and non-mobile industrial, commercial, and residential applications.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine or being relatively closer to the engine outlet as compared to another component. Additionally, as used herein, the terms "radial" or "radially" refer to a dimension extending between a center longitudinal axis of the engine and an outer engine circumference. Furthermore, as used herein, the term "set" or a "set" of elements can be any number of elements, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 is a schematic cross-sectional diagram of a gas turbine engine 10 for an aircraft. The engine 10 has a generally longitudinally extending axis or engine centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the engine centerline 12. The HP compressor 26, the combustor 30, and the HP turbine 34 form a core 44 of the engine 10, which generates combustion gases. The core 44 is surrounded by core casing 46, which can be coupled with the fan casing 40.

A HP shaft or spool 48 disposed coaxially about the engine centerline 12 of the engine 10 drivingly connects the HP turbine 34 to the HP compressor 26. A LP shaft or spool 50, which is disposed coaxially about the engine centerline 12 of the engine 10 within the larger diameter annular HP spool 48, drivingly connects the LP turbine 36 to the LP compressor 24 and fan 20. The spools 48, 50 are rotatable about the engine centerline and couple to a plurality of rotatable elements, which can collectively define a rotor 51.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the engine centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor can be mounted to a disk 61, which is mounted to the corresponding one of the HP and LP spools 48, 50, with each stage having its own disk 61. The vanes 60, 62 for a stage of the compressor can be mounted to the core casing 46 in a circumferential arrangement.

The HP turbine 34 and the LP turbine 36 respectively include a plurality of turbine stages 64, 44, in which a set of turbine blades 68, 70 are rotated relative to a corresponding set of static turbine vanes 72, 74 (also called a nozzle) to extract energy from the stream of fluid passing through the stage. In a single turbine stage 64, 44, multiple turbine blades 68, 70 can be provided in a ring and can extend radially outwardly relative to the engine centerline 12, from a blade platform to a blade tip, while the corresponding static turbine vanes 72, 74 are positioned upstream of and adjacent to the rotating blades 68, 70. It is noted that the number of blades, vanes, and turbine stages shown in FIG. 1 were selected for illustrative purposes only, and that other numbers are possible.

The blades 68, 70 for a stage of the turbine can be mounted to a disk 71, which is mounted to the corresponding one of the HP and LP spools 48, 50, with each stage having a dedicated disk 71. The vanes 72, 74 for a stage of the compressor can be mounted to the core casing 46 in a circumferential arrangement.

Complementary to the rotor portion, the stationary portions of the engine 10, such as the static vanes 60, 62, 72, 74 among the compressor and turbine sections 22, 32 are also referred to individually or collectively as a stator 63. As such, the stator 63 can refer to the combination of non-rotating elements throughout the engine 10.

In operation, the airflow exiting the fan section 18 is split such that a portion of the airflow is channeled into the LP compressor 24, which then supplies pressurized air 76 to the HP compressor 26, which further pressurizes the air. The pressurized air 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be drawn from the pressurized airflow 76 and provided to engine components requiring cooling. The temperature of pressurized airflow 76 entering the combustor 30 is significantly increased. As such, cooling provided by the bleed air 77 is necessary for operating of such engine components in the heightened temperature environments.

A remaining portion of the airflow 78 bypasses the LP compressor 24 and engine core 44 and exits the engine assembly 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

Figure 2:
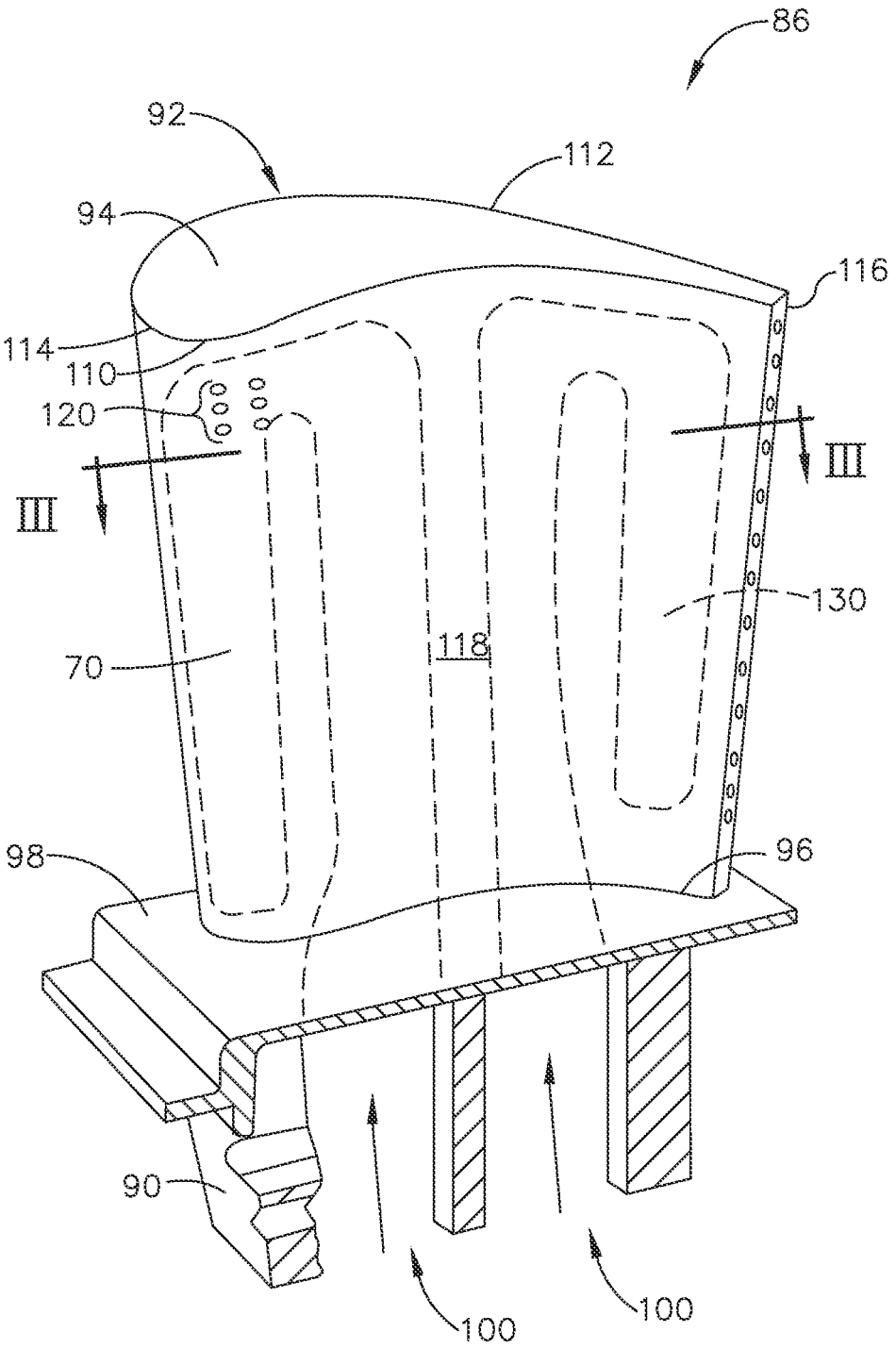
FIG. 2 is a perspective view of a turbine blade for the turbine engine from FIG. 1 including at least one cooling hole located along a leading edge of the turbine blade.

FIG. 2 is a perspective view of an engine component in the form of a turbine blade assembly 86 with a turbine blade 70 of the engine 10 from FIG. 1. Alternatively, the engine component can include a vane, a strut, a service tube, a shroud, or a combustion liner in non-limiting examples, or any other engine component that can require or utilize cooling passages.

The turbine blade assembly 86 includes a dovetail 90 and an airfoil 92. The airfoil 92 extends between a tip 94 and a root 96 to define a span-wise direction 97. The airfoil 92 mounts to the dovetail 90 on a platform 98 at the root 96. When multiple airfoils are circumferentially arranged in side-by-side relationship, the platforms 98 help to radially contain the turbine engine mainstream air flow. The dovetail 90 can be configured to mount to the turbine rotor disk 71 on the engine 10. The dovetail 90 further includes at least one inlet passage 100, exemplarily shown as two inlet passages 100, each extending through the dovetail 90 to provide internal fluid communication with the airfoil 92. It should be appreciated that the dovetail 90 is shown in cross-section, such that the inlet passages 100 are housed within the body of the dovetail 90.

The airfoil 92 includes a concave-shaped pressure side 110 and a convex-shaped suction side 112 which are joined together to define an airfoil shape of the airfoil 92 extending between a leading edge 114 and a trailing edge 116 to define a chord-wise direction 117. The airfoil 92 is bound by an outer wall 118 and defined by the pressure and suction sides 110, 112. The interior of the airfoil can be solid, hollow, and/or having multiple cooling circuits or passages 130 illustrated in dashed line. At least one cooling hole 120, illustrated as three cooling holes located along the outer wall 118, can be located at any suitable location of the engine component.

Figure 3:
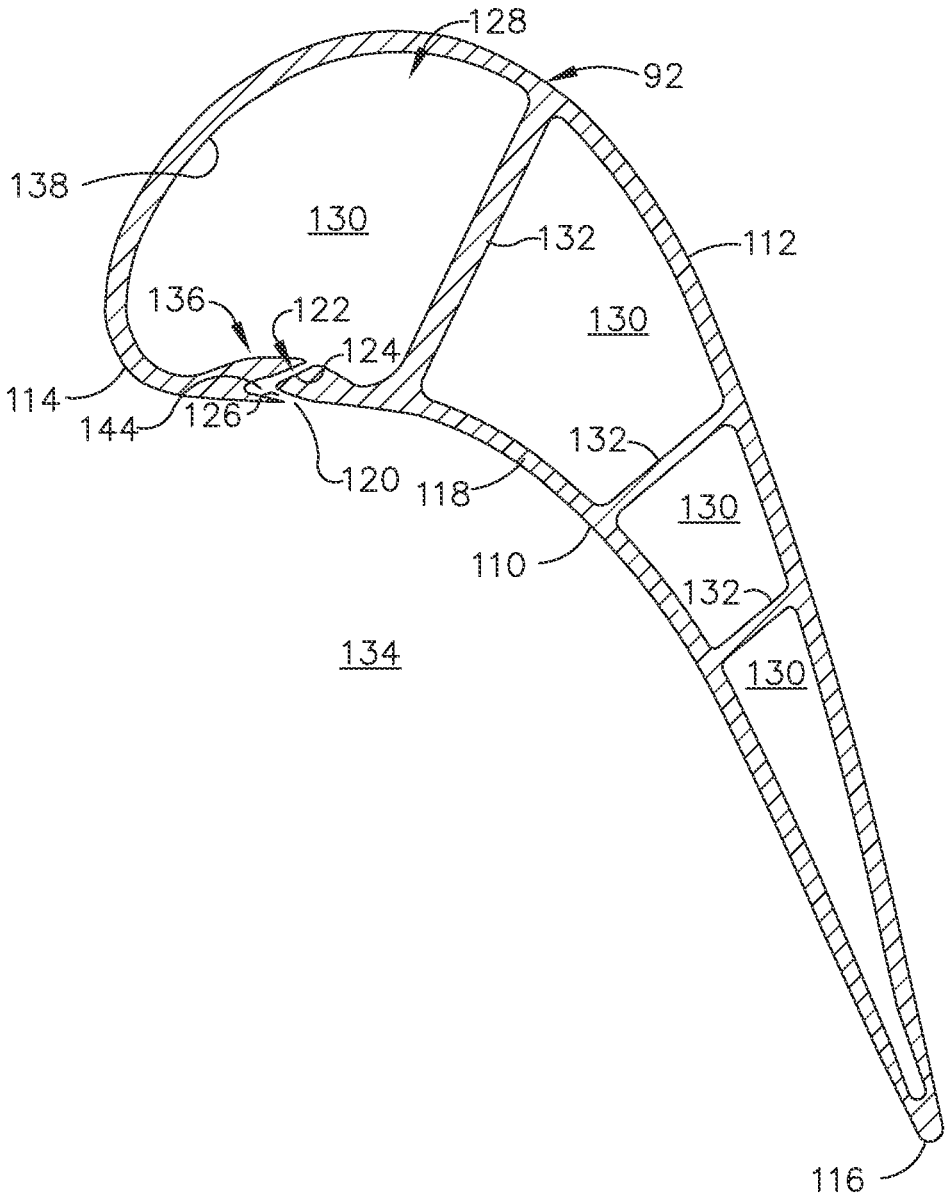
FIG. 3 is a cross-section of the turbine blade from FIG. 2 taken along line III-III.

FIG. 3 is a cross-section taken along line of FIG. 2 showing the at least one cooling hole 120 within the outer wall 118. An interior 128 of the airfoil 92 is bound by outer wall 118 and can include multiple cooling passages 130. The multiple cooling passages 130 can be fluidly coupled with at least one of the inlet passages 100 (FIG. 2). The multiple cooling passages 130 can be separated by interior walls 132. Interior walls 132 can extend between the pressure and suction sides 110, 112 as illustrated, and in other non-limiting examples can be any wall within the airfoil 92 and defining at least a portion of the multiple cooling passages 130. The at least one cooling hole 120 can fluidly couple the interior 128 of the airfoil 92 to an exterior 134 of the airfoil 92.

The at least one cooling hole 120 can pass through a substrate, which by way of illustration is outer wall 118. It should be understood, however, that the substrate can be any wall within the engine 10 including but not limited to the interior walls 132, a tip wall, or a combustion liner wall. Materials used to form the substrate include, but are not limited to, steel, refractory metals such as titanium, or superalloys based on nickel, cobalt, or iron, and ceramic matrix composites. The superalloys can include those in equiaxed, directionally solidified, and crystal structures. The substrate can be formed by, in non-limiting examples, 3D printing, investment casting, or stamping.

It is contemplated that the at least one cooling hole includes a connecting passage 122 having a first portion 124 and a second portion 126 and an impingement cavity 144 located between the first portion 126 and the second portion 126. In an aspect of the disclosure herein, a thickened wall portion 136 local to the at least one cooling hole 120 on an interior surface 138 of the at least one cooling passage 130 is formed in order to accommodate the first and second portions 124, 126 of the connecting passage 122 for the at least one cooling hole 120 within the outer wall 118. The thickened wall portion 136 can be provided anywhere along the interior surface 138. The thickened wall portion 136 can also be formed as a flow enhancer for flow going through cooling passage 130. Pin fins, dimples, turbulators, or any other type of flow enhancer can also be provided along the interior surface 138. It should be understood that forming a flow enhancer, by way of non-limiting example a turbulator, can include forming the thickened wall portion 136 and the at least one cooling hole 120 passes through an interior of the turbulator.

Figure 4:
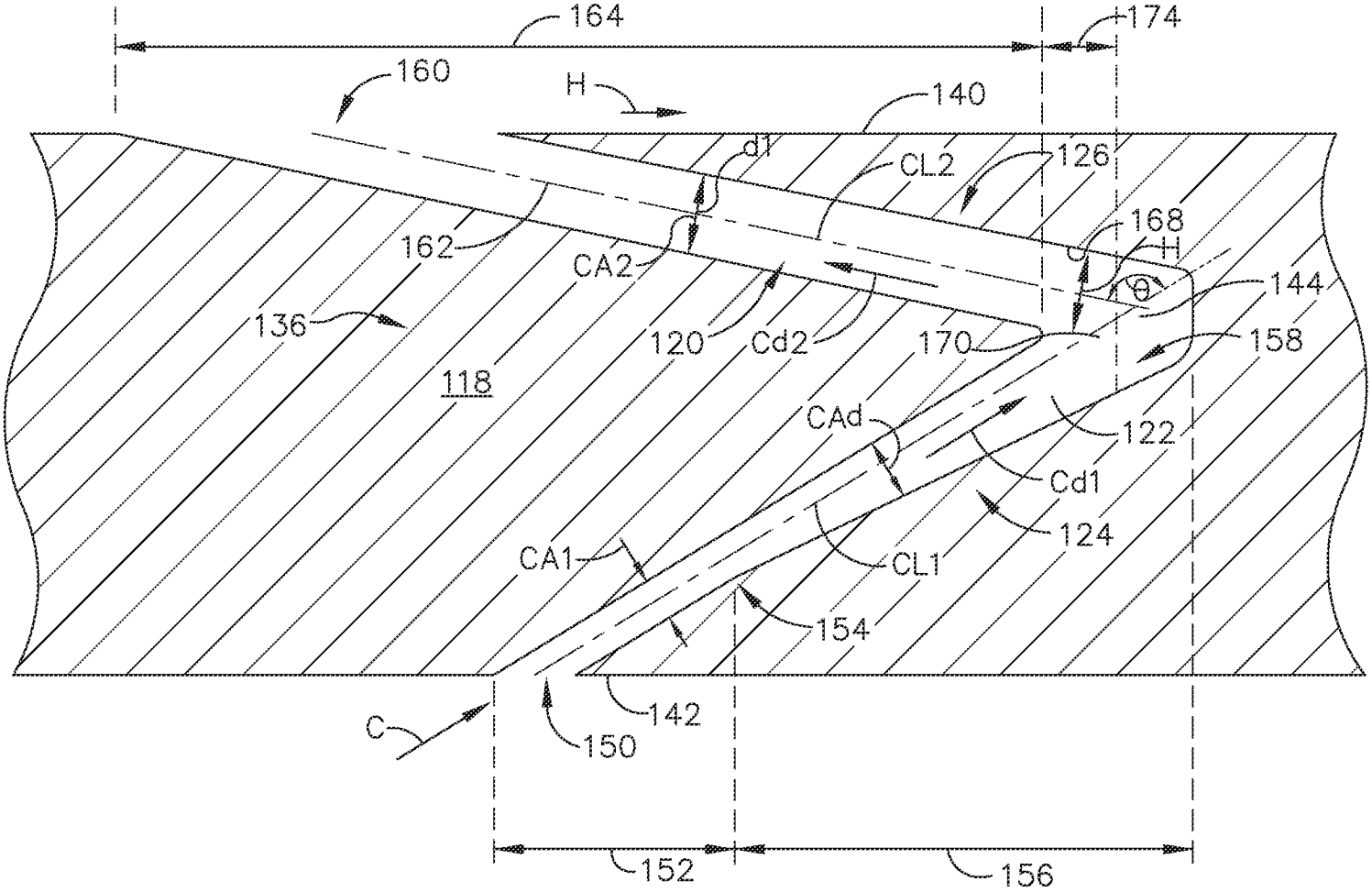
FIG. 4 is a schematic side sectional view of the at least one cooling hole from FIG. 2 according to an aspect of the disclosure herein.

The at least one cooling hole 120 is illustrated in more detail in FIG. 4. The outer wall 118 extends between an exterior, or heated surface 140, facing a hot gas flow (H), and an interior, or cooled surface 142, facing a cooling fluid flow (C). It should be understood that the heated surface 140 and the cooled surface 142 are relative to each other and can be any range of temperatures during engine operation. It should be understood that the outer wall 118 can include the thickened portion 136.

It is noted that the outer wall 118 as described herein is shown generally planar, however it is understood that the outer wall 118 can be for curved engine components. The curvature of an engine component in such an example can be slight in comparison to the size of the cooling hole 120, and so for purposes of discussion and illustration is shown as planar. Whether the outer wall 118 is planar or curved local to the at least one cooling hole 120, the hot and cooled surfaces 140, 142 can be parallel to each other as shown herein or can lie in non-parallel planes.

The first portion 124 of the connecting passage 122 can include at least one inlet 150 located at the cooled surface 142. At least one metering section 152 can be fluidly coupled to the at least one inlet 150 and define at least part of the first portion 124 of the connecting passage 122. The at least one metering section 152 can be provided at or near the at least one inlet 150. As illustrated, the at least one metering section 152 defines the smallest cross-sectional area of the connecting passage 122. It should be appreciated that more than one metering section 152 can be formed in the connecting passage 122. The at least one metering section 152 can extend from the at least one inlet 150 to a transition location 154 where the cross-sectional area of the connecting passage 122 begins to increase. It is further contemplated that the metering section 150 has no length and can define the transition location 154. The metering section can have a first cross-sectional area (CA1) which can be a circular shape, though any cross-sectional shape is contemplated. A first centerline (CL1) can pass through the geometric center for the first cross-sectional area (CA1) and extend a full length of the first portion 124 of the connecting passage 122.

At least one diffusing section 156 can be provided downstream of the at least one inlet 150 to define at least a part of the first portion 124 of the connecting passage 122. In one exemplary implementation, the at least one diffusing section 156 is fluidly coupled to the at least one metering section 152 at the transition location 154. A diffusing cross-sectional area (CAd) of the connecting passage 122 can increase extending downstream from the transitional location 154 to define the at least one diffusing section 156. The at least one diffusing section 156 terminates in at least one intermediate outlet 158. In one example, the diffusing cross-sectional area (CAd) is continuously increasing as illustrated. In one alternative, non-limiting implementation, the increasing diffusing cross-sectional area (CAd) can be a discontinuous or step-wise increasing cross-sectional area.

The second portion 126 of the connecting passage 122 can include at least one outlet 160 located at the heated surface 140. The second portion 126 of the connecting passage 122 can include at least one branch 162 having a second cross-sectional area (CA2). The second cross-sectional area (CA2) can increase or remain constant. A second centerline (CL2)

can pass through the geometric center for the second cross-sectional area (CA2) and extend a full length of the second portion 126 of the connecting passage 122. It is further contemplated that the at least one branch 162 includes a secondary diffusing section 164 and the secondary diffusing section 164 defines the at least one outlet 160.

The impingement cavity 144 can be formed in the connecting passage 122 and be located between the first portion 126 and the second portion 126. The impingement cavity 144 can have an impingement surface 168 located opposite of the at least one intermediate outlet 158. The impingement surface 168 can define a surface area of at least the same size as the first cross-sectional area (CA1) or the diffusing cross-sectional area (CAd). The impingement cavity 144 can define a turn 170. The turn 170 can be measured from the first centerline (CL1) through an angle θ toward the second centerline (CL2). The turn 170 is preferably an angle θ greater than or equal to 90 degrees. It is further contemplated that the angle θ is between 70 and 180 degrees. In some implementations the angle can be less than 70 degrees.

The connecting passage 122 connects the at least one inlet 150 to the at least one outlet 160 through which a cooling fluid (C) can flow. The at least one metering section 152 can meter the mass flow rate of the cooling fluid (C). The at least one diffusing section 156 enables expansion of the cooling fluid (C) to form a first diffused airflow (Cd1). The impingement cavity 144 enables impingement of the cooling fluid (C) on the impingement surface 144. In one aspect of the disclosure herein the impingement cavity 144 defines a stagnation zone 174 where the cooling fluid (C) has a zero velocity produced by the turn 170. The cooling fluid (C) can exit through the at least one outlet 160 after passing through the impingement cavity 144. The secondary diffusing section 164 can be in serial flow communication with the impingement cavity 144 of the connecting passage 122. The secondary diffusing section 164 can form a second diffused airflow (Cd2). It is alternatively contemplated that the at least one diffusing section 156 extends along the entirety of the first portion 124 of the at least one cooling hole 120. It is further contemplated that the impingement cavity 144 is fluidly coupled to the at least one outlet 160 with little or no secondary diffusing section 164 present.

Figure 5:
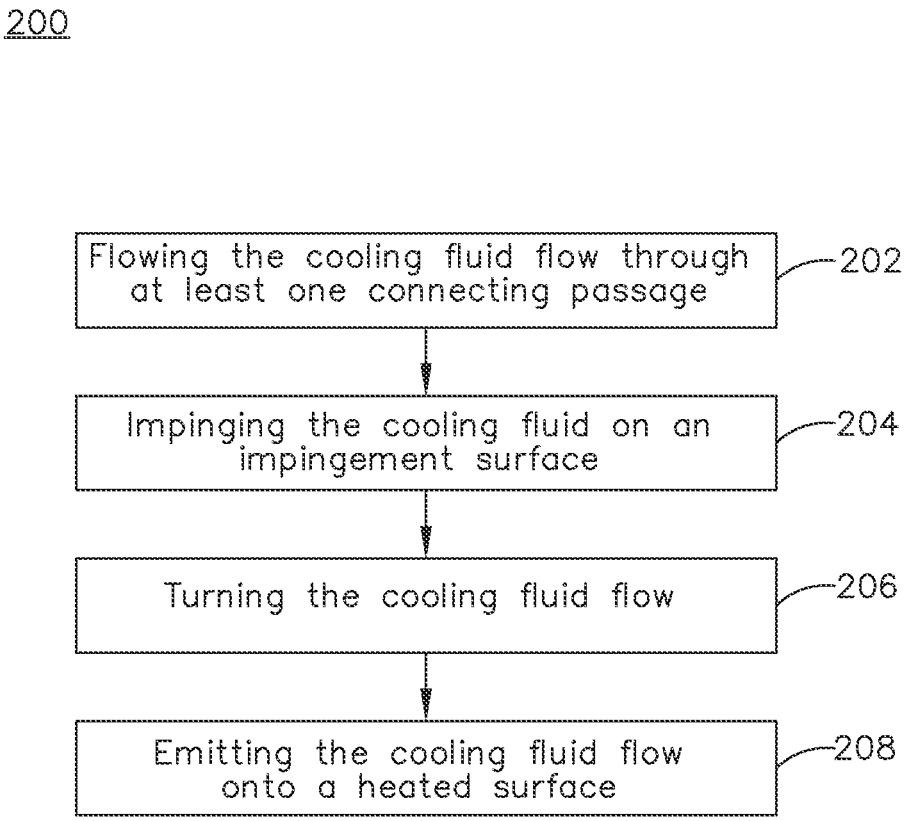
FIG. 5 is a flow chart for a method of cooling the turbine blade from FIG. 2.

FIG. 5 shows a flow chart of a method 200 of cooling the engine component as described herein. The method includes at 202 flowing the cooling fluid flow (C) through the at least one connecting passage 122. At 204 impinging the cooling fluid flow (C) on the impingement surface 168. At 206 turning the cooling fluid flow (C) at the turn 170. Turning the cooling fluid flow (C) can further include turning the cooling fluid flow (C) through an angle greater than or equal to 90 degrees. It is further contemplated that the method can include slowing the cooling fluid flow (C) to a velocity of zero. At 208 the method includes emitting the cooling fluid flow onto the heated surface 140.

It is further contemplated that the method can include diffusing the cooling fluid flow (C). By way of non-limiting example the diffusing of the cooling fluid flow (C) can occur in the at least one diffusing section 156, the secondary diffusing section 164, or in both diffusing sections 156, 164. It is further contemplated that the secondary diffusing section 164 is located in the first or second branches 162*a*, 162*b*, or in both branches 162*a*, 162*b* as described herein. The method can further include splitting the cooling fluid flow into multiple branches 162.

The diffusing the cooling fluid flow (C) can further include forming the first diffused airflow (Cd1) before turning the cooling fluid flow (C) at 206 and forming the second diffused airflow (Cd2) after turning the cooling fluid flow (C). The method can further include emitting the second diffused airflow (Cd2) onto the heated surface 140.

Figure 6:
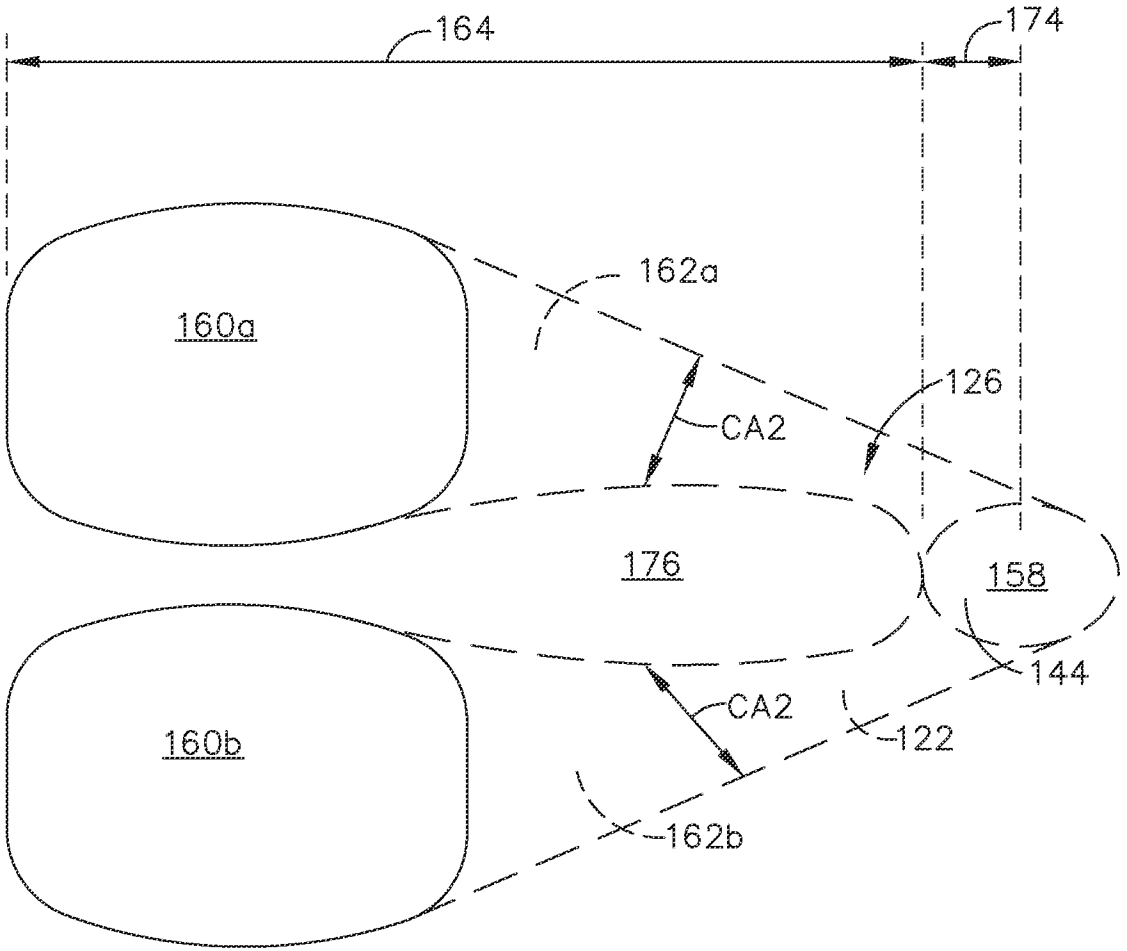
FIG. 6 is a schematic top sectional view of the at least one cooling hole in FIG. 4 according to another aspect of the disclosure herein.

Turning to FIG. 6, in an aspect of the disclosure herein a top view of the at least one cooling hole 120 contemplates the at least one outlet 160 as two outlets 160*a*, 160*b*. The second portion 126 of the connecting passage 122 is illustrated in dashed line as having multiple branches 162, by way of non-limiting example a first branch 162*a* fluidly coupled to a first outlet 160*a* and a second branch 162*b* fluidly coupled to a second outlet 160*b*. The multiple branches 162 can be separated by a tear drop shaped wall 176. The tear drop shaped wall 176 can utilize the coanda effect and enable a controlled expansion of the cooling fluid (C) when flowing through the multiple branches 162*a*, 162*b*. The tear drop shaped wall 176 can be formed to enhance the secondary diffusing section 164 or in place of a secondary diffusing section 164.

Figure 7:
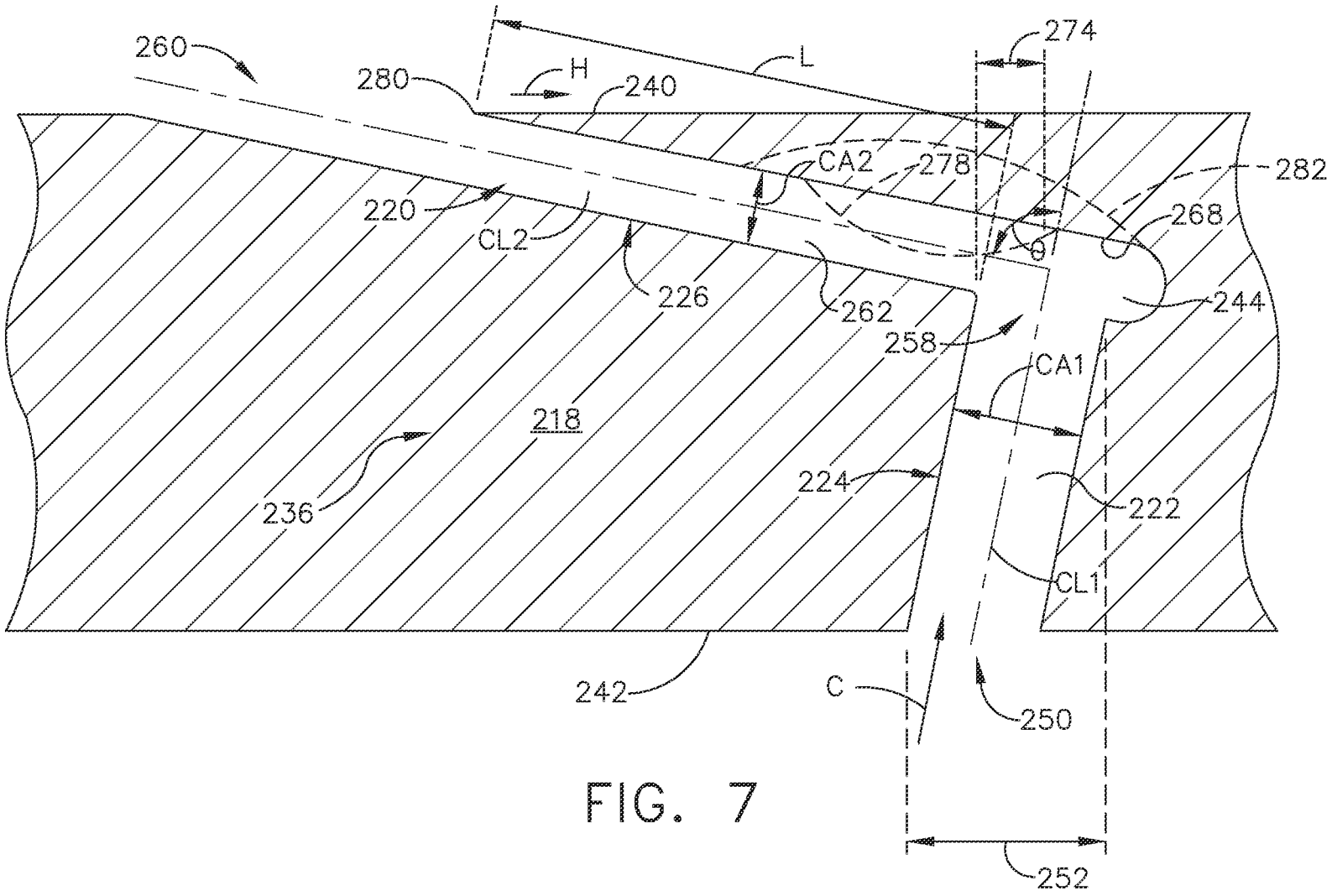
FIG. 7 is a variation of the side sectional view of the at least one cooling hole from FIG. 2 according to another aspect of the disclosure discussed herein.

FIG. 7 is a cooling hole 220 according to another aspect of the disclosure discussed herein. The at least one cooling hole 220 is substantially similar to the at least one cooling hole 120. Therefore, like parts will be identified with like numerals increased by 100, with it being understood that the description of the like parts of the at least one cooling hole 120 applies to the at least one cooling hole 220 unless otherwise noted.

The at least one cooling hole 220 includes a connecting passage 222. The connecting passage 222 can include a first portion 224 extending between at least one inlet 250 and an intermediate outlet 258. The connecting passage 222 can define a first cross-sectional area (CA1), by way of non-limiting example a circular cross-sectional area though any cross-sectional shape is contemplated. A corresponding first centerline (CL1) can pass through the geometric center of the first cross-sectional area (CA1) and extend a full length of the first portion 224 of the connecting passage 222. The first cross-sectional area (CA1) can be a constant cross-sectional area defining at least one metering section 252 provided at or near the at least one inlet 250. As illustrated, the at least one metering section 252 defines the smallest cross-sectional area of the connecting passage 222. It should be appreciated that more than one metering section 252 can be formed in the connecting passage 222.

A second portion 226 of the connecting passage 222 can include at least one outlet 260 located at a heated surface 240. The second portion 226 of the connecting passage 222 can have a second cross-sectional area (CA2). The second cross-sectional area (CA2) can increase, decrease, or remain constant along a length (L) defining a branch 262 of the second portion 226 extending between an upstream edge 280 of the outlet 260 and the intermediate outlet 258. A second centerline (CL2) can pass through the geometric center for the second cross-sectional area (CA2) and extend a full length of the second portion 226 of the connecting passage 222.

An impingement cavity 244 can be formed in the connecting passage 222 and be located downstream of the first portion 224. It is contemplated that the impingement cavity 244 defines the second portion 226 of the connecting passage 222. In one aspect of the disclosure herein, the impingement cavity 244 defines the outlet 260 and the length (L) of the branch 262 is very small or zero. The impingement cavity 244 can have an impingement surface 268 located opposite of the at least one intermediate outlet 258. The impingement surface 268 can define a surface area of at least the same size as the first cross-sectional area (CA1). The impingement cavity 244 can define a turn 270. The turn 270 can be measured from the first centerline (CL1) through an angle θ toward the second centerline (CL2). According to an aspect of the disclosure herein, the angle θ is 90 degrees.

It is further contemplated that the impingement cavity 244 can include a depressed portion 278. The depressed portion 278 is illustrated in dashed line and can be formed to decrease the second cross-sectional area (CA2) located in a relatively central location within the impingement cavity 244. In an alternate variation, the impingement cavity 244 can include a dome 282 illustrated in dashed line that is formed to increase the second cross-sectional area (CA2). Cooling air (C) can plume, or move around within the impingement cavity 244 before exiting through outlet 260.

Figure 8:
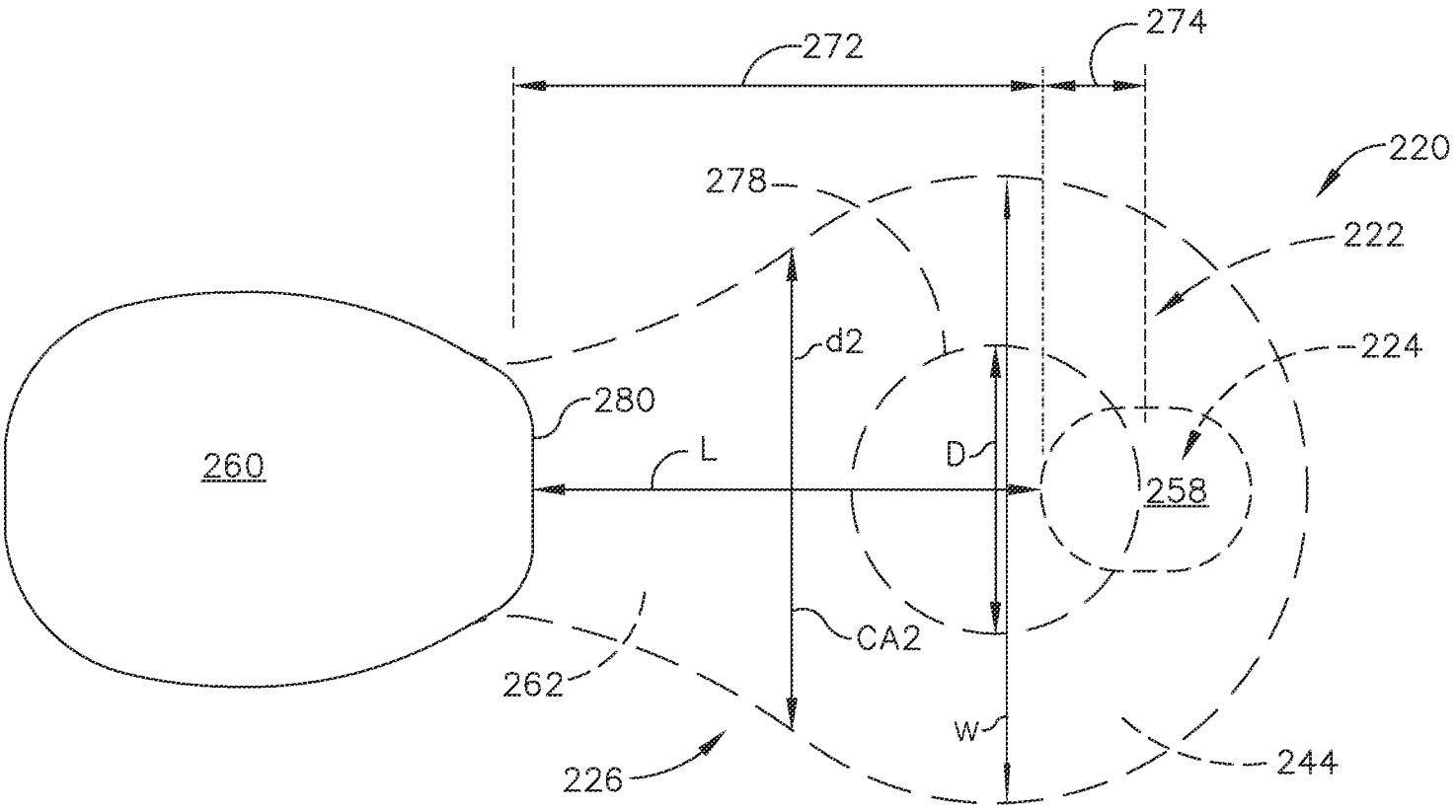
FIG. 8 is a schematic top sectional view of the at least one cooling hole from FIG. 7.

Turning to FIG. 8, a top view of the at least one cooling hole 220 is depicted in which the impingement cavity 244 is fluidly coupled to the first portion 224 of the connecting passage 222 via a single intermediate outlet 258. In an aspect of the disclosure herein, the second portion 226 impingement cavity 244 can be a disc-shape, by way of non-limiting example a hockey puck shape such that the impingement cavity 244 is a round chamber in which the cooling fluid (C) impinges, plumes, and flows. It is contemplated that the impingement surface 268 (FIG. 7) can be larger than the first cross-sectional area (CA1) and define a surface of the disc-shape opposite the intermediate outlet 258. The branch 262 can include an inverse diffusing section 272, where the second cross-sectional area (CA2) decreases along the length (L) from a stagnation zone 274 toward the outlet 260. In an aspect of the disclosure herein where the impingement cavity 244 includes a depressed portion 278, the disc-shaped impingement cavity would be a biconcave disc shape with the depressed portion 278 having some diameter (D). In one aspect the depressed portion 278 overlaps with the single intermediate outlet 258 where impingement occurs at least in part on the depressed portion 278.

Figure 9:
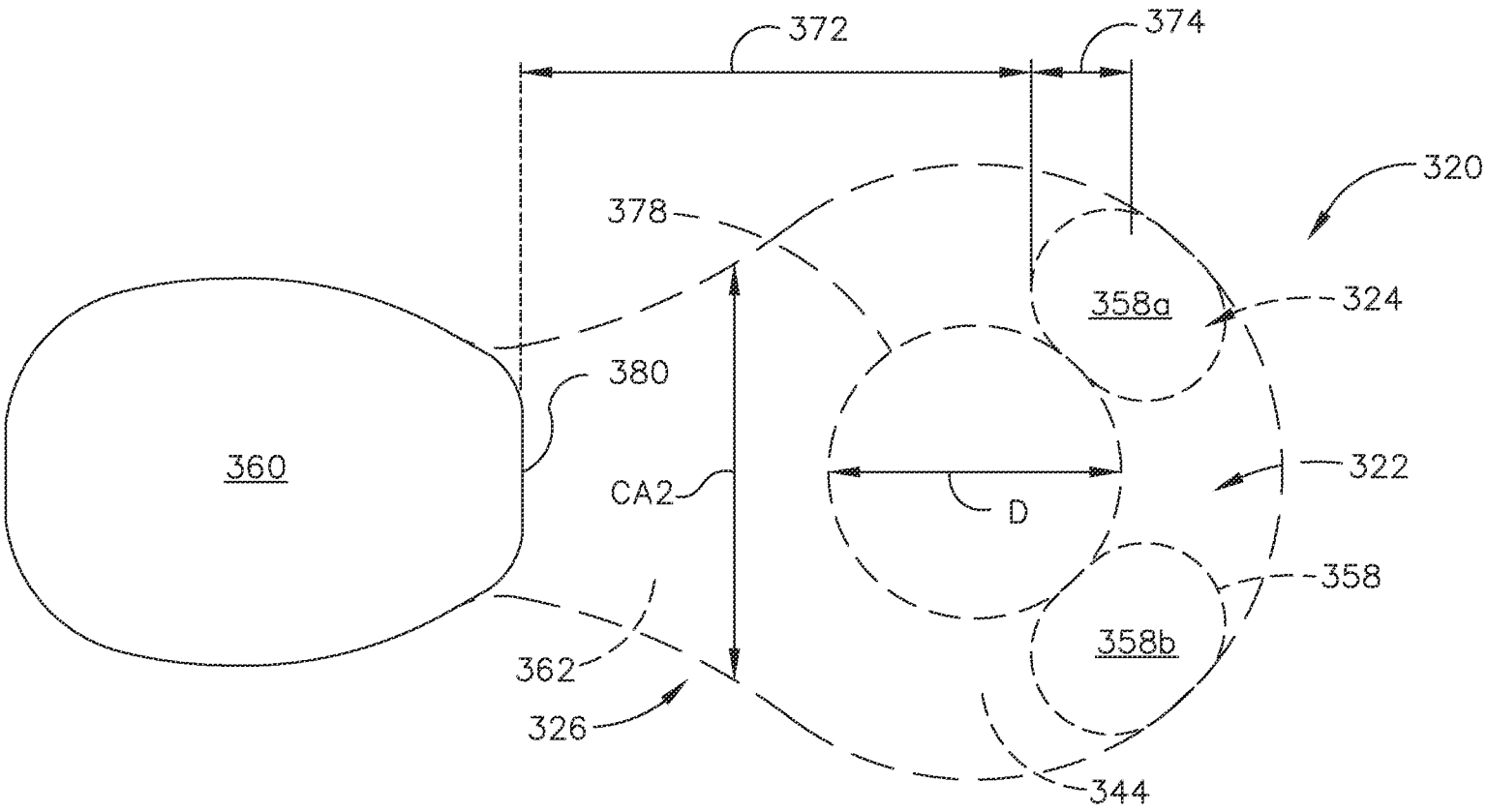
FIG. 9 is a variation of the schematic top sectional view from FIG. 8 according to yet another aspect of the disclosure herein.

FIG. 9 is a cooling hole 320 according to another aspect of the disclosure discussed herein. The at least one cooling hole 320 is substantially similar to the at least one cooling hole 220. Therefore, like parts will be identified with like numerals increased by 100, with it being understood that the description of the like parts of the at least one cooling hole 220 applies to the at least one cooling hole 320 unless otherwise noted.

A top view of the at least one cooling hole 320 includes an impingement cavity 344 having a concave disc shape with a depressed portion 378, which by way of non-limiting example can be centrally located within the impingement cavity 344 and at least partially form an impingement surface (similarly to 268 FIG. 7). The depressed portion 378 defines some diameter (D) beyond which at least one intermediate outlet 358 is located. As illustrated, the at least one intermediate outlet 358 can be two intermediate outlets 358*a*, 358*b* fluidly coupling the impingement cavity 344 to a first portion, similar to first portion 224 (FIG. 6) of a connecting passage 322 as described herein. It should be understood that while described as having at least two intermediate outlets 358*a*, 358*b* beyond a diameter (D) of the depressed portion 378, the at least two intermediate outlets 358*a*, 358*b* can be formed within a disc-shaped impingement cavity 344 having no depressed portion 378. It is also contemplated that at least one of the intermediate outlets 358*a*, 358*b* intersects with the depressed portion 378 where impingement occurs at least in part on the depressed portion 378.

Figure 10:
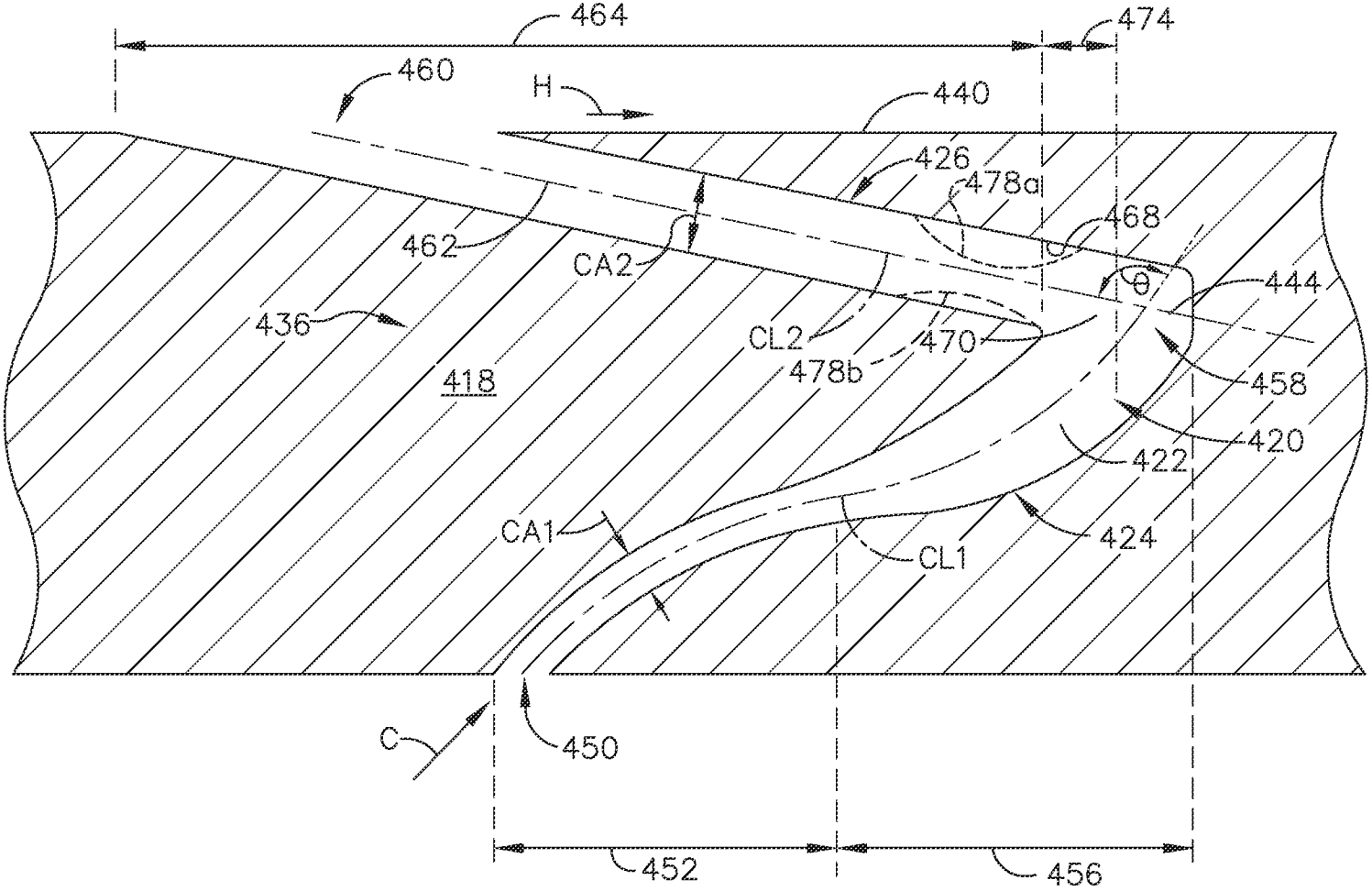
FIG. 10 is a variation of the side sectional view of the at least one cooling hole from FIG. 2 according to yet another aspect of the disclosure discussed herein.

FIG. 10 is a cooling hole 420 according to another aspect of the disclosure discussed herein. The at least one cooling hole 420 is substantially similar to the at least one cooling hole 120. Therefore, like parts will be identified with like numerals increased by 300, with it being understood that the description of the like parts of the at least one cooling hole 120 applies to the at least one cooling hole 420 unless otherwise noted.

In an aspect of the disclosure herein a first portion 424 of the at least one cooling hole 420 can include a metering section 452 defining a first cross-sectional area (CA1) which can be a circular shape, though any cross-sectional shape is contemplated. A first centerline (CL1) can pass through the geometric center for the first cross-sectional area (CA1) and extend a full length of the first portion 424 of the connecting passage 422. As illustrated, the first centerline (CL1) can be a curvilinear centerline.

It is further contemplated that an impingement cavity 444 can include a depressed portion 478*a*. The depressed portion 478*a* is illustrated in dashed line and can be formed to decrease the second cross-sectional area (CA2). The depressed portion 478*a* can be centrally located with respect to the impingement cavity 444, or be anywhere within a second portion 426 of the at least one cooling hole 420. The depressed portion 478*a* can be located opposite another depressed portion 478*b* to decrease the second cross-sectional area (CA2) even further. Together the depressed portions 478*a*, 478*b* can define a biconcave disc shape for the impingement cavity 444.

It should be understood that any combination of the geometry of the cooling holes as described herein is contemplated. The varying aspects of the disclosure discussed herein are for illustrative purposes and not meant to be limiting.

Benefits associated with the at least one cooling hole as described herein are related to increased coverage of the engine component with minimal penetration. More specifically the at least one cooling hole and the variations thereof described herein increase coverage by combining diffusing and impinging with a turn. Any increase in coverage yields a higher film effectiveness and lower metal temperatures for the engine component described herein. This increases the life of the engine component as well as increase efficiencies throughout the engine.

The sets of cooling holes as described herein can be manufactured utilizing additive manufacturing technologies or other advanced casing manufacturing technologies such as investment casting and 3-D printing. The technologies available provide cost benefits along with the other benefits described. It should be understood that other methods of forming the cooling circuits and cooling holes described herein are also contemplated and that the methods disclosed are for exemplary purposes only.

It should be appreciated that application of the disclosed design is not limited to turbine engines with fan and booster sections, but is applicable to turbojets and turbo engines as well.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A component for a turbine engine, which generates a hot gas flow, and provides a cooling fluid flow, comprising:

a wall separating the hot gas flow from the cooling fluid flow and having a heated surface along which the hot gas flows and a cooled surface facing the cooling fluid flow; and at least one cooling hole comprising at least one inlet at the cooled surface, at least one outlet at the heated surface, at least one connecting passage extending between the at least one inlet and the at least one outlet, with an impingement cavity formed in the at least one connecting passage, the at least one connecting passage including a first portion upstream of the impingement cavity and a second portion downstream of the impingement cavity, the second portion having an inverse diffusing section with a converging section having a cross-sectional area defining a first dimension and a second dimension perpendicular to the first dimension, the second dimension decreasing toward the at least one outlet;

wherein the impingement cavity has a height oriented in a same direction as the first dimension and a width oriented in the same direction as the second dimension, where the width is greater than the height.

2. The component of claim 1, wherein the impingement cavity defines a turn located between the first portion and the second portion.

3. The component of claim 2, wherein the turn further defines a stagnation zone.

4. The component of claim 2, wherein the first portion has a first cross-sectional area defining a first centerline and the second portion has a second cross-sectional area defining a second centerline and the turn is an angle greater than 70 degrees formed between the first and second centerline.

5. The component of claim 4, wherein at least one of the first or second centerlines is a curvilinear centerline.

6. The component of claim 2, wherein the impingement cavity is a disc-shaped impingement cavity.

7. The component of claim 6, wherein the disc-shaped impingement cavity comprises a biconcave disc shape with a depressed portion.

8. The component of claim 7, wherein the first portion of the at least one connecting passage intersects the disc-shape impingement cavity beyond a diameter of the depressed portion.

9. The component of claim 2, wherein the first portion comprises a primary diffusing section terminating at the turn.

10. The component of claim 9, wherein the inverse diffusing section is a secondary diffusing section located downstream of the impingement cavity.

11. The component of claim 10, wherein the secondary diffusing section defines the at least one outlet.

12. The component of claim 1, wherein the inverse diffusing section includes a diverging section having a cross-sectional area that increases at the at least one outlet.

13. The component of claim 1, wherein at least one of the first portion or the second portion define multiple branches of the connecting passage.

14. The component of claim 1, wherein at least one of the at least one outlet or the at least one inlet is multiple outlets or multiple inlets.

15. The component of claim 1, wherein the wall further comprises a thickened wall portion through which the connecting passage extends.

16. A component for a turbine engine, which generates a hot gas flow, and provides a cooling fluid flow, comprising:

a wall separating the hot gas flow from the cooling fluid flow and having a heated surface along which the hot gas flows and a cooled surface facing the cooling fluid flow; and at least one cooling hole comprising at least one inlet at the cooled surface and at least one outlet at the heated surface, at least one connecting passage extending between the at least one inlet and the at least one outlet, the at least one connecting passage comprising:

a first portion extending in a first direction having a first cross-sectional area defining a first centerline, a second portion extending in a second direction different than the first direction and having a second cross-sectional area defining a second centerline, the second cross-sectional area defining a first dimension perpendicular to the second centerline and a second dimension parallel to the second centerline, a turn located between the first portion and the second portion and defining an impingement cavity, and a diffusing section located in the first portion with the first cross-sectional area increasing in the first direction toward the turn, wherein the impingement cavity is a disc-shaped impingement cavity having a height oriented in a same direction as the first dimension and a width oriented in the same direction as the second dimension, where the width is greater than the height.

17. The component of claim 16, wherein the first centerline is a curvilinear centerline.

18. The component of claim 16, wherein the first portion of the at least one connecting passage shares an edge with the impingement cavity.

19. The component of claim 16, wherein the at least one of the outlet or inlet is multiple outlets or multiple inlets.

20. The component of claim 16, wherein the disc-shaped impingement cavity comprises a depressed portion and wherein the first portion of the at least one connecting passage intersects the disc-shape impingement cavity beyond a diameter of the depressed portion.

* * * * *